US005918403A

United States Patent [19]

Lurz, Jr. et al.

[11] Patent Number: 5,918,403

[45] Date of Patent: Jul. 6, 1999

[54] GUN SAFETY DEVICE

[75] Inventors: Francis H. Lurz, Jr., Miramar, Fla.; Daniel J. Willis, 10641 SW. 57th Pl., Fort Lauderdale, Fla. 33028

[73] Assignee: Daniel J. Willis, Fort Lauderdale, Fla.

[21] Appl. No.: 09/037,084

[22] Filed: Mar. 9, 1998

[51] Int. Cl.[6] ..... F41A 17/44

[52] U.S. Cl. ..... 42/70.11; 42/66

[58] Field of Search ..... 42/70.11, 70.01, 42/66

[56] References Cited

U.S. PATENT DOCUMENTS

| | | | |
|---|---|---|---|
| 2,327,334 | 8/1943 | Parker | 42/70.11 |
| 2,479,107 | 8/1949 | Garretson | 42/70.11 |
| 2,763,081 | 9/1956 | Huckabee | 42/70.11 |
| 2,887,807 | 5/1959 | Santangelo | 42/70.11 |
| 3,154,874 | 11/1964 | Stewart | 42/70.11 |
| 4,023,294 | 5/1977 | Knopp | 42/70.11 |
| 4,398,366 | 8/1983 | Wernicki | 42/70.11 |
| 4,479,320 | 10/1984 | Fix | 42/70.11 |
| 4,512,099 | 4/1985 | Mathew | 42/70.11 |
| 4,783,924 | 11/1988 | Thurber | 42/70.11 |
| 4,827,649 | 5/1989 | Sheehan | 42/70.11 |
| 4,908,971 | 3/1990 | Chaney | 42/70.11 |
| 5,048,211 | 9/1991 | Hepp | 42/70.11 |
| 5,179,234 | 1/1993 | Cvetanovich | 42/70.11 |
| 5,357,704 | 10/1994 | Benkovic | 42/70.11 |
| 5,450,685 | 9/1995 | Peterson | 42/70.11 |
| 5,491,918 | 2/1996 | Elmstedt | 42/70.11 |

FOREIGN PATENT DOCUMENTS

| | | | |
|---|---|---|---|
| 8600396 | 1/1986 | WIPO | 42/70.11 |

*Primary Examiner*—Stephen M. Johnson
*Attorney, Agent, or Firm*—Oltman,Flynn & Kubler

[57] ABSTRACT

A gun safety device for use with a firearm having a barrel and a chamber comprising a first tube with a wedge-shaped outer end and an internally threaded bore extending longitudinally within the first tube, a second tube with a wedge-shaped inner end structured for engagement with the wedge-shaped outer end of the first tube and a bore extending longitudinally within the length of the second tube and a rod translatable within the first and second tubes and including an externally threaded portion structured for mating engagement with the internally threaded bore of the first tube. The first and second tubes are structured for removable insertion into the barrel of the firearm so that the inner end of the first tube extends into the chamber of the firearm, the wedge-shaped outer end of the first tube and the wedge-shaped inner end of the second tube are positioned in the barrel and the flange is seated against the outer edge of the barrel. Translating the rod so as to urge the first and second tubes towards each other causes the wedge-shaped outer end of the first tube to engage the wedge-shaped inner end of the second tube, thereby causing the wedge-shaped outer end of the first tube and the wedge-shaped inner end of the second tube to be biased transversely into engagement with the inside sidewall of the firearm barrel.

16 Claims, 1 Drawing Sheet

GUN SAFETY DEVICE

BACKGROUND OF THE INVENTION

1. Field of the Invention

The present invention relates generally to the field of firearms and, more particularly, to a safety device which prevents the firing of a firearm.

2. Description of the Related Art

The need for safety devices for firearms has long been recognized. Countless people, especially children, have been injured or even killed due the accidental discharge of firearms. Consequently, various safety devices have been developed to address this problem. However, firearms are often maintained by people for protection and, therefore, must be readily available. Thus, there is a need for safety devices for firearms which can be disabled, thereby rendering the firearm operable, fairly quickly.

Several safety devices have been developed for firearms. Many, such as those disclosed in U.S. Pat. Nos. 2,327,334, 2,479,107, 2,763,081, 4,398,366, 4,783,924 and 4,908,971 comprise a rod type member inserted into the barrel which extends into the chamber, means, such as a dummy bullet, cartridge or protrusion, in the chamber for anchoring or securing the rod type member, an outer member inserted over the end of the rod type member extending out of the barrel and, in some cases, the outer end of the barrel itself, and some type of locking means for preventing the removal of the outer member from the rod and/or barrel. Although these prior art references are useful for their intended purposes, none has proven to be entirely effective. Specifically, these devices require the insertion and/or assembly of several different members, some in the barrel and some in the chamber, and are, therefore, cumbersome and difficult to utilize. Furthermore, because they include several different members including, in most instances, a keylock, they are expensive and cannot be quickly removed. Also, the means for securing these devices are located in the chamber, which may not be desirable and may not function properly with automatic weapons and other firearms having configurations which differ from that of revolvers.

Another device, shown in U.S. Pat. No. 4,512,099, discloses a Gun Locking Device comprising a tube extending within the length of the barrel, a rod translatable within the tube and having a first end extending into the chamber and an opposite end extending out of the outer end of the barrel, a first wedge, with a forward facing inclined surface, positioned in the chamber on the end of the rod, a second wedge, with a rearwardly facing inclined surface for engagement with the forwardly facing inclined surface of the first wedge, encompassing the rod between the first wedge and the innermost end of the tube, and means for translating the rod, thereby urging the first wedge towards the second wedge causing the wedges to be biased transversely into engagement with the adjacent wall of the throat of the barrel. However, like the other prior art devices discussed above, this device has also not proven to be entirely effective. Specifically, this device is also difficult to utilize. It requires the separate steps of first inserting the tube and rod into the barrel and then the wedges into the chamber, before the rod is translated to urge the wedges together. Likewise, removal of the device requires the same number of steps, including the removal of a lock and, thus, may not be accomplished quickly. Additionally, because it also includes the lock and several other members, this device may be expensive. Also, the engagement between the wedges and the firearm which secures this device in place occurs in the chamber of the firearm, which may not be desirable and may not function properly with automatic weapons and other firearms having configurations which differ from that of revolvers. Furthermore, it appears that the transversely biased wedges of this device engage the shoulder or vertical walls defining the outermost end of the chamber and the innermost end of the barrel and, not the walls forming the outer circumference of the chamber.

Accordingly, there is still a need in the art for a universal Gun Safety Device with means for securing the device to the barrel, and not the chamber, so that it may be used with revolvers, shotguns, automatic weapons and other firearms with configurations which differ from that of a revolver. Any such device should include a minimum of components, thereby making it simple to install, inexpensive, and quickly removable and ready for use. The present invention is particularly suited to overcome those problems which remain in the art in a manner not previously known.

SUMMARY OF THE INVENTION

The present invention is directed towards a new and improved gun safety device for use with a firearm having a barrel and a chamber comprising a first tube with a wedge-shaped outer end and an internally threaded bore extending longitudinally within the first tube and accessible from the wedge-shaped outer end, a second tube with a wedge-shaped inner end structured for engagement with the wedge-shaped outer end of the first tube, a bore extending longitudinally within the length of the second tube and a flange on the outer end, and a rod translatable within the first and second tubes so as to urge the first and second tubes towards or away from each other and including an externally threaded portion structured for mating engagement with the internally threaded bore of the first tube. The first and second tubes are structured for removable insertion into the barrel of the firearm so that the inner end of the first tube extends into the chamber of the firearm, the wedge-shaped outer end of the first tube and the wedge-shaped inner end of the second tube are positioned in the barrel and the flange is seated against the outer edge of the barrel. Urging the first and second tubes towards each other causes the wedge-shaped outer end of the first tube to engage the wedge-shaped inner end of the second tube, thereby causing the wedge-shaped outer end of the first tube and the wedge-shaped inner end of the second tube to be biased transversely into engagement with the inside sidewall of the firearm barrel.

It is an object of the present invention to provide a new and improved gun safety device which has all the advantages of the prior art devices and none of the disadvantages.

It is another object of the present invention to provide a universal gun safety device which can be utilized with revolvers, shotguns, automatic weapons and firearms having other configurations. The gun can be loaded except for the chamber where the safety device is inserted.

It is also an object of the present invention to provide a universal gun safety device which accomplishes the above stated objective by being secured to the barrel.

It is yet another object of the present invention to provide a gun safety device which prevents the loading of the chamber of the gun.

It is a further object of the present invention to provide such an apparatus which is simple, durable, inexpensive to manufacture and quickly removable and ready for use.

These and other objects and advantages of the present invention will become more readily apparent in the description which follows.

BRIEF DESCRIPTION OF THE DRAWINGS

For a fuller understanding of the nature of the present invention, reference should be had to the following detailed description, taken in connection with the accompanying drawings in which.

Like reference numerals refer to like parts throughout the several views of the drawings.

DETAILED DESCRIPTION OF THE PREFERRED EMBODIMENT

Figure 1:
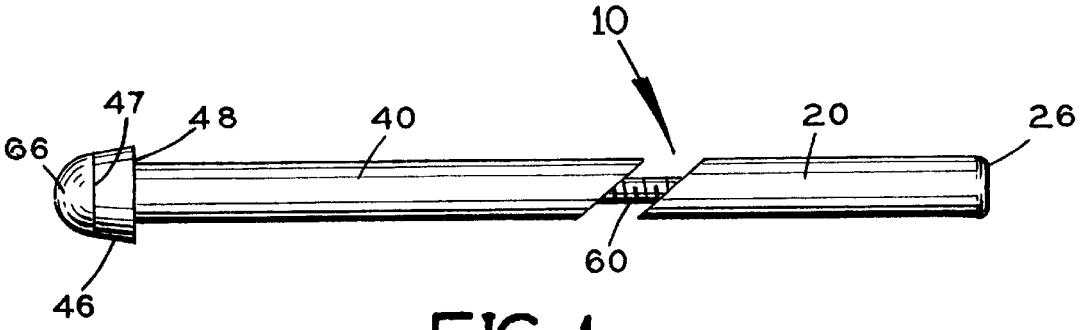
FIG. 1 is a side perspective view of the gun safety device of the present invention.
Figure 2:
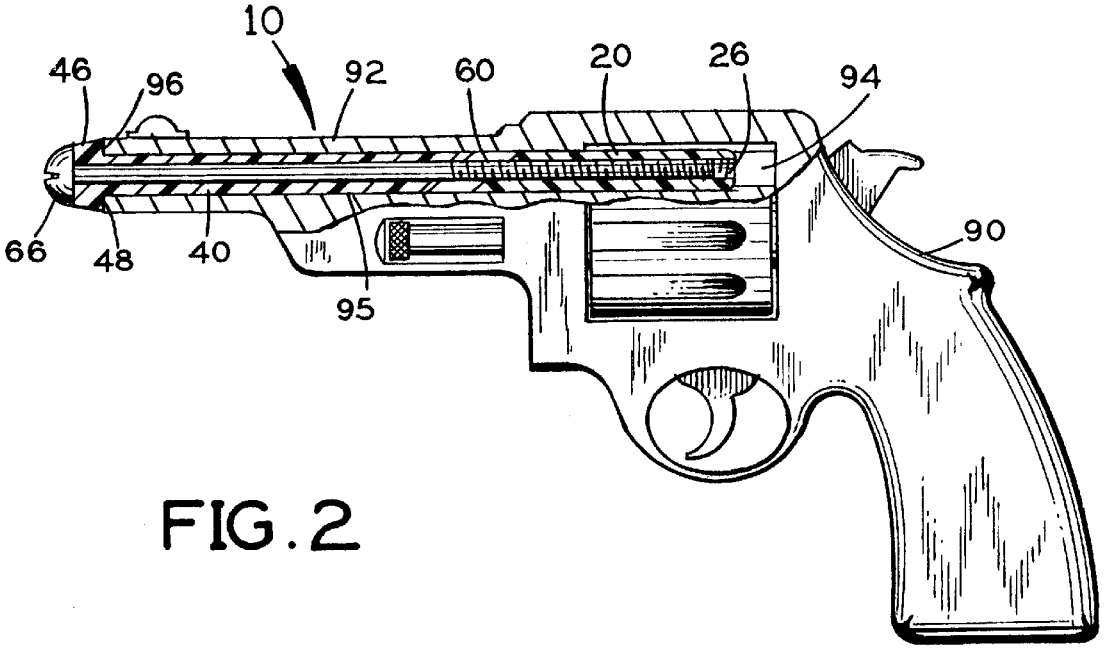
FIG. 2 is a side perspective view of a firearm, in partial section, showing the gun safety device of the present invention inserted inside of the firearm.
Figure 3:
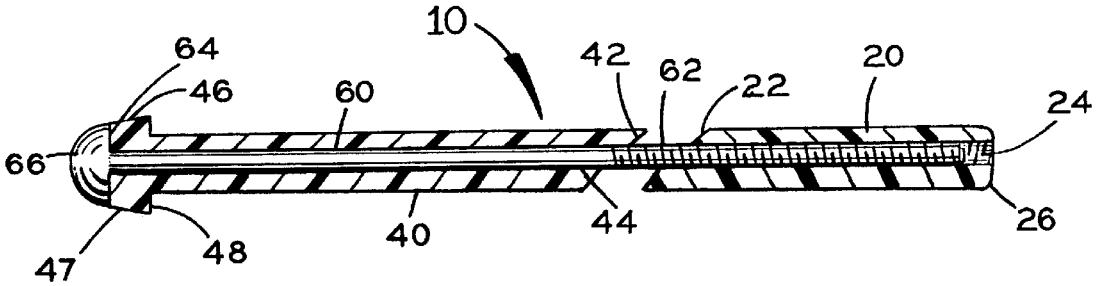
FIG. 3 is a side perspective view of the gun safety device of the present invention, in partial section, showing the rod inside of the first and second tubes.

As shown in FIGS. 1–3, the present invention is directed towards a new and improved gun safety device 10 for use with a firearm 90 having a barrel 92 and a chamber 94 comprising a first tube 20, a second tube 40 and a rod 60 translatable within the first 20 and second 40 tubes. The first tube 20 includes a wedge-shaped outer end 22 and an internally threaded bore 24 extending longitudinally within the first tube 20 and accessible from the wedge-shaped outer end 22.

The second tube 40 includes a wedge-shaped inner end 42 structured for engagement with the wedge-shaped outer end 22 of the first tube 20, a bore 44 extending longitudinally within the length of the second tube 40 and a flange 46 on the outer end 48 of the second tube 40.

The first 20 and second 40 tubes are structured for removable insertion into the barrel 92 of the firearm 90 so that the inner end 26 of the first tube 20 extends into the active chamber 94 of the firearm 90, the wedge-shaped outer end 22 of the first tube 20 and the wedge-shaped inner end 42 of the second tube 40 are positioned in the barrel 92 and the flange 46 is seated against the outer edge 96 of the barrel 92. The inner end 26 of the first tube 20 in the active chamber 94 of the firearm 90 prevents the loading of bullets into the active chamber 94. The flange 46 is tapered so that its outside diameter decreases towards the distal edge 47, thereby increasing the difficulty of gripping the flange 46 and making removal of the device 10 from the firearm 90 more difficult.

The preferred angle of the wedge-shaped outer end 22 of the first tube 20 and the wedge-shaped inner end 42 of the second tube 40 is sixteen degrees (16°) to optimize the holding ability of the engaged wedges 22, 42. However other suitable angles may be utilized. Angles over sixteen degrees (16°) may require a positive locking device to prevent slipping of the wedges 22, 42 relative to one another. Angles under sixteen degrees (16°) will have greater holding abilities and, correspondingly, will require a greater force to release the wedges 22, 42 from one another.

The first 20 and second tubes 40 are preferably constructed of Delrin, a form of Acetal, but may, alternatively, be constructed of any other suitable material. Acetal is a virtually faultless material which offers a combination of properties not available with metals and most other materials. Acetal is a tough, stable thermoplastic with a high modulus of elasticity and high strength, rigidity and dimensional stability. Additionally, Acetal has a low coefficient of friction, is non-abrasive and exhibits a high natural lubricity and a low moisture absorption rate.

The rod 60 includes an externally threaded portion 62 structured for mating engagement with the internally threaded bore 24 of the first tube 20. The rod 60 is translatable within the first 20 and second 40 tubes so as to urge the first 20 and second 40 tubes towards or away from each other. In the preferred embodiment, a tamper resistant torx screw head 66 is included on the outer end 64 of the rod 60 to provide a means for translating the rod 60 within the first 20 and second 40 tubes. The tamper resistant torx screw head 66 requires the use of a special tool, thereby providing an additional safety aspect. Several screw heads with different configurations are available.

In use, the rod 60 is inserted through the bore 44 in the second tube 40, into the internally threaded bore 24 of the first tube 20 and translated until mated with the internally threaded bore 24. the first 20 and second 40 tubes are then inserted into the barrel 92 of the firearm 90 until the flange 46 is seated against the outer edge 96 of the barrel 92. Using the special torx tool, the rod 60 is then translated, urging the first 20 and second 40 tubes towards each other and causing the wedge-shaped outer end 22 of the first tube 20 to engage the wedge-shaped inner end 42 of the second tube 40. Continued translation of the rod 60 after the wedge-shaped outer end 22 of the first tube 20 and the wedge-shaped inner end 42 of the second tube 40 are in complete engagement causes the wedge-shaped outer end 22 of the first tube 20 and the wedge-shaped inner end 42 of the second tube 40 to be biased transversely into secured engagement with the inside sidewall 95 of the firearm 90 barrel 92, thereby preventing the removal of the device 10. Translation of the rod 60 in the reverse direction acts to urge the wedge-shaped outer end 22 of the first tube 20 and the wedge-shaped inner end 42 of the second tube 40 longitudinally away from one another, thereby facilitating the removal of the device 10.

Various changes may be made within the spirit and scope of the invention as described above.

What is claimed is:

1. A gun safety device for use with a firearm having a barrel and a chamber comprising:

a first tube having an inner end and an opposite wedge-shaped outer end;

a second tube having a wedge-shaped inner end, an opposite outer end and a bore extending longitudinally within the length of said second tube, said wedge-shaped inner end of said second tube being structured for engagement with said wedge-shaped outer end of said first tube;

said first and second tubes being structured for removable insertion into said barrel of said firearm so that said inner end of said first tube extends into said chamber of said firearm and said wedge-shaped outer end of said first tube and said wedge-shaped inner end of said second tube are positioned in said barrel of said firearm;

a rod translatable within said first and second tubes; and means for translating said rod within said first and second tubes so as to urge said first and second tubes towards or away from each other, whereby urging said first and second tubes towards each other causes said wedge-shaped outer end of said first tube to engage said wedge-shaped inner end of said second tube, thereby causing said wedge-shaped outer end of said first tube and said wedge-shaped inner end of said second tube to be biased transversely into engagement with an inside wall of said barrel of said firearm.

2. A gun safety device for use with a firearm having a barrel and a chamber as recited in claim 1 wherein said means for translating said rod within said first and second tubes comprises an internally threaded bore extending longitudinally within said first tube and accessible from said wedge-shaped outer end of said first tube and an externally threaded portion on said rod structured for mating engagement with said internally threaded bore of said first tube.

3. A gun safety device for use with a firearm having a barrel and a chamber as recited in claim 2 further comprising a torx screw head on an outer end of said rod.

4. A gun safety device for use with a firearm having a barrel and a chamber as recited in claim 1 further comprising a flange on said outer end of said second tube, said flange being structured to be seated against an outer edge of said barrel of said firearm when said second tube is inserted into said barrel.

5. A gun safety device for use with a firearm having a barrel and a chamber as recited in claim 4 wherein said flange is tapered so that said flange may not be easily gripped.

6. A gun safety device for use with a firearm having a barrel and a chamber as recited in claim 1 wherein said wedge-shaped outer end of said first tube forms a certain angle with the longitudinal axis of said first tube within the range of seven degrees and thirty decrees and said wedge-shaped inner end of said second tube forms a certain angle with the longitudinal axis of said second tube within the range of seven degrees and thirty degrees.

7. A gun safety device for use with a firearm having a barrel and a chamber comprising:

a first tube having an inner end, an opposite wedge-shaped outer end and an internally threaded bore extending longitudinally within said first tube and accessible from said wedge-shaped outer end;

a second tube having a wedge-shaped inner end, an opposite outer end and a bore extending longitudinally within the length of said second tube, said wedge-shaped inner end of said second tube being structured for engagement with said wedge-shaped outer end of said first tube, said first and second tubes being structured for removable insertion into said barrel of said firearm so that said inner end of said first tube extends into said chamber of said firearm and said wedge-shaped outer end of said first tube and said wedge-shaped inner end of said second tube are positioned in said barrel of said firearm; and a rod translatable within said first and second tubes so as to urge said first and second tubes towards or away from each other, said rod including an externally threaded portion structured for mating engagement with said internally threaded bore of said first tube, whereby urging said first and second tubes towards each other causes said wedge-shaped outer end of said first tube to engage said wedge-shaped inner end of said second tube, thereby causing said wedge-shaped outer end of said first tube and said wedge-shaped inner end of said second tube to be biased transversely into engagement with an inside wall of said barrel of said firearm.

8. A gun safety device for use with a firearm having a barrel and a chamber as recited in claim 7 further comprising a torx screw head on an outer end of said rod.

9. A gun safety device for use with a firearm having a barrel and a chamber as recited in claim 7 further comprising a flange on said outer end of said second tube, said flange being structured to be seated against an outer edge of said barrel of said firearm when said second tube is inserted into said barrel.

10. A gun safety device for use with a firearm having a barrel and a chamber as recited in claim 9 wherein said flange is tapered so that said flange may not be easily gripped.

11. A gun safety device for use with a firearm having a barrel and a chamber as recited in claim 7 wherein said wedge-shaped outer end of said first tube forms a certain angle with the longitudinal axis of said first tube within the range of seven degrees and thirty degrees and said wedge-shaped inner end of said second tube forms a certain angle with the longitudinal axis of said second tube within the range of seven degrees and thirty degrees.

12. A gun safety device for use with a firearm having a barrel and a chamber comprising:

a first tube having an inner end, an opposite wedge-shaped outer end and an internally threaded bore extending longitudinally within said first tube and accessible from said wedge-shaped outer end;

a second tube having a wedge-shaped inner end structured for engagement with said wedge-shaped outer end of said first tube, an opposite outer end with a flange and a bore extending longitudinally within the length of said second tube, said first and second tubes being structured for removable insertion into said barrel of said firearm so that said inner end of said first tube extends into said chamber of said firearm, said wedge-shaped outer end of said first tube and said wedge-shaped inner end of said second tube are positioned in said barrel of said firearm and said flange is seated against an outer edge of said barrel of said firearm, said flange being tapered so that said flange may not be easily gripped; and a rod translatable within said first and second tubes so as to urge said first and second tubes towards or away from each other, said rod including an externally threaded portion structured for mating engagement with said internally threaded bore of said first tube, whereby urging said first and second tubes towards each other causes said wedge-shaped outer end of said first tube to engage said wedge-shaped inner end of said second tube, thereby causing said wedge-shaped outer end of said first tube and said wedge-shaped inner end of said second tube to be biased transversely into engagement with an inside wall of said barrel of said firearm.

13. A gun safety device for use with a firearm having a barrel and a chamber as recited in claim 12 further comprising a torx screw head on an outer end of said rod.

14. A gun safety device for use with a firearm having a barrel and a chamber as recited in claim 12 wherein said wedge-shaped outer end of said first tube forms a certain angle with the longitudinal axis of said first tube within the range of seven degrees and thirty degrees and said wedge-shaped inner end of said second tube forms a certain angle with the longitudinal axis of said second tube within the range of seven degrees and thirty degrees.

15. A gun safety device for use with a firearm having a barrel and a chamber comprising:

a first tube having an inner end and an opposite wedge-shaped outer end;

a second tube having a wedge-shaped inner end, an opposite outer end and a bore extending longitudinally within the length of said second tube, said wedge-shaped inner end of said second tube being structured for engagement with said wedge-shaped outer end of said first tube;

said first and second tubes being structured for removable insertion into said barrel of said firearm so that said inner end of said first tube extends into said chamber of said firearm and said wedge-shaped outer end of said first tube and said wedge-shaped inner end of said second tube are positioned in said barrel of said firearm;

a rod translatable within said first and second tubes; and means for translating said rod within said first and second tubes so as to urge said first and second tubes towards or away from each other, whereby urging said first and second tubes towards each other causes said wedge-shaped outer end of said first tube to engage said wedge-shaped inner end of said second tube, thereby causing said wedge-shaped outer end of said first tube and said wedge-shaped inner end of said second tube to be biased transversely into engagement with an inside wall of said barrel of said firearm;

wherein said means for translating said rod within said first and second tubes comprises an internally threaded bore extending longitudinally within said first tube.

16. A gun safety device for use with a firearm having a barrel and a chamber as recited in claim 15 further comprising a torx screw head on an outer end of said rod.

* * * * *